US010303090B2

(12) United States Patent
Saito

(10) Patent No.: US 10,303,090 B2
(45) Date of Patent: May 28, 2019

(54) DEVELOPING APPARATUS

(71) Applicant: CANON KABUSHIKI KAISHA, Tokyo (JP)

(72) Inventor: Fumiyoshi Saito, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/969,937

(22) Filed: May 3, 2018

(65) Prior Publication Data

US 2018/0341196 A1 Nov. 29, 2018

(30) Foreign Application Priority Data

May 26, 2017 (JP) ..... 2017-105063

(51) Int. Cl.
*G03G 15/08* (2006.01)

(52) U.S. Cl.
CPC ..... *G03G 15/0891* (2013.01); *G03G 15/0865* (2013.01); *G03G 2215/0802* (2013.01)

(58) Field of Classification Search
CPC ..... G03G 15/0893; G03G 15/0891; G03G 15/0889; G03G 15/0877; G03G 2215/0838
See application file for complete search history.

(56) References Cited

U.S. PATENT DOCUMENTS 9,291,945 B2 3/2016 Saito
9,405,229 B1 * 8/2016 Nose ..... G03G 15/0893
9,645,527 B2 5/2017 Saito et al.
9,658,573 B2 5/2017 Saito
2008/0187332 A1 * 8/2008 Tsuda ..... G03G 15/0898 399/27
2015/0248078 A1 9/2015 Mugita et al.
2016/0004182 A1 1/2016 Yago et al.

FOREIGN PATENT DOCUMENTS

JP 2005-221852 A 8/2005

OTHER PUBLICATIONS

Osamu Ariizumi, et al., U.S. Appl. No. 15/982,023, filed May 17, 2018.

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

A developing apparatus includes a partition member disposed in a first chamber above a discharge space communicated to the discharge port positioned downstream of a return conveyance portion in the first direction, and configured to divide a space within a first chamber in a gravity direction. The partition member is configured to extend from a wall portion on a downstream side of a developer container to a position corresponding to a downstream end of a return conveyance portion or to a position further upstream beyond the position corresponding to the downstream end of the return conveyance portion in the first direction. A surface, opposed to a first conveyance screw, of the partition member is positioned downward in the gravity direction than an upper end of a first communication port and upward in the gravity direction than the first conveyance screw.

7 Claims, 14 Drawing Sheets

DEVELOPING APPARATUS

BACKGROUND OF THE INVENTION

Field of the Invention

The present invention relates to a developing apparatus suitable for an image forming apparatus that utilizes an electrophotography technique, such as a printer, a copying machine, a facsimile or a multifunction machine.

Description of the Related Art

Image forming apparatuses such as printers, copying machines, facsimiles and multifunction machines are equipped with a developing apparatus configured to develop and visualize an electrostatic latent image formed on a photosensitive drum using developer. A two-component developer composed of nonmagnetic toner and magnetic carrier is utilized in the developing apparatus. In the two-component developer (hereinafter simply referred to as developer), the carrier is deteriorated after being used repeatedly for a long time. If the deteriorated carrier is used repeatedly, amount of toner charge of developer is reduced, and developer whose toner charge is reduced may cause image defects such as fogging or soiling of interior of the apparatus by toner scattering. Therefore, a developing apparatus adopting an ACR configuration is proposed in which new carrier is replenished when replenishing approximately the same amount of toner as toner consumed by image forming and discharging excessive developer that contains deteriorated carrier through a discharge port so as to suppress lowering of toner charge (Japanese Patent Laid-Open Publication No. 2005-221852). In the developing apparatus adopting an ACR (Auto Carrier Refreshing) configuration, among the developer conveyed by a conveyance screw toward a discharge port, developer having reached the discharge port moving against a push-back force of a return screw is discharged to an exterior of the developer container.

Hitherto, in the conventional developing apparatus, there was a case where a small amount of developer was discharged continuously through the discharge port even though there is only a small amount of developer in the developer container, and the amount of developer in the developer container became too small. This is caused by airflow flowing toward a conveyance direction of developer being generated along with a rotation of a conveyance screw, and developer flipped up by the conveyance screw being conveyed by the airflow to move beyond the return screw toward the discharge port. Since airflow is generated regardless of the amount of developer in the developer container, developer will be discharged even if there is only a small amount of developer. Then, if the amount of developer in the developer container becomes too small, image defects such as a portion of the image missing due to lack of supply of developer to a developing sleeve may be caused.

SUMMARY OF THE INVENTION

The present invention provides a developing apparatus configured to suppress discharge of developer from a discharge port caused by airflow that occurs by the rotation of a screw conveying developer.

According to one feature of the present invention, a developing apparatus includes a developer container including a first chamber in which a discharge port of developer is formed and a second chamber that forms a circulation path of developer with the first chamber, a first conveyance screw disposed in the first chamber and including a conveyance portion configured to convey developer to a first direction toward the discharge port, and a return conveyance portion disposed upstream of the discharge port in the first direction and configured to convey developer conveyed by the conveyance portion in a second direction that is opposite to the first direction, a partition wall configured to separate the first chamber and the second chamber in the developer container with first and second communication ports, the first communication port being disposed on a downstream side in the first direction and configured to deliver developer from the first chamber to the second chamber, the second communication port being disposed on an upstream side in the first direction and configured to deliver developer from the second chamber to the first chamber, and a partition member disposed in the first chamber above a discharge space communicated to the discharge port positioned downstream of the return conveyance portion in the first direction, and configured to divide a space within the first chamber in a gravity direction. The first conveyance screw is arranged such that an upstream end in the first direction of the return conveyance portion is overlapped with the first communication port. The partition member is configured to extend from a wall portion on a downstream side of the developer container to a position corresponding to a downstream end of the return conveyance portion or to a position further upstream beyond the position corresponding to the downstream end of the return conveyance portion in the first direction. A surface, opposed to the first conveyance screw, of the partition member is positioned downward in the gravity direction than an upper end of the first communication port and upward in the gravity direction than the first conveyance screw.

Further features of the present invention will become apparent from the following description of exemplary embodiments with reference to the attached drawings.

DESCRIPTION OF THE EMBODIMENTS

First Embodiment

A first embodiment will now be described with reference to FIGS. 1 through 11. At first, a general configuration of an image forming apparatus adopting a developing apparatus according to a present embodiment will be described with reference to FIGS. 1 and 2.

Image Forming Apparatus

An image forming apparatus 100 is a tandem-type full-color image forming apparatus adopting an electrophotographic system. The image forming apparatus 100 includes first, second, third and fourth image forming portions PY, PM, PC and PK respectively forming yellow, magenta, cyan and black images. The image forming apparatus 100 forms a toner image on a recording material according to an image signal from a document reading apparatus (not shown) connected to an apparatus body 100A or a host device (not shown) such as a personal computer connected in a communicatable manner to the apparatus body 100A. The recording material can be paper, plastic film, cloth and other sheet material.

The four image forming portions PY, PM, PC and PK in the image forming apparatus 100 adopt similar configurations, except for the difference in the developed colors. Therefore, the image forming portion PK will be described as a representative example, and the other image forming portions will not be described.

Figure 2:
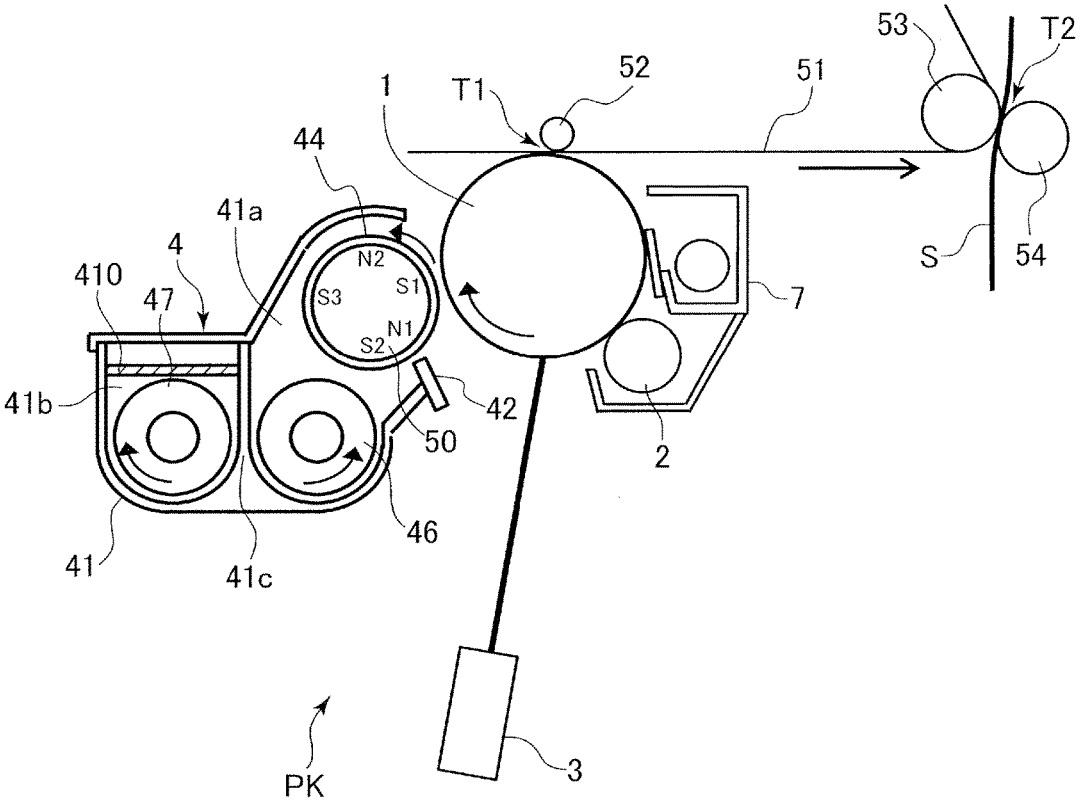
FIG. 2 is a schematic configuration diagram illustrating a periphery of an image forming portion.

A cylindrical photosensitive member, that is, a photosensitive drum 1, is arranged as an image bearing member in the image forming portion PK, as illustrated in FIG. 2. The photosensitive drum 1 is driven to rotate in a direction of an arrow in the drawing. A charging device 2, a developing apparatus 4, a primary transfer roller 52 and a cleaning device 7 are arranged in a periphery of the photosensitive drum 1. A laser scanner 3 such as an exposing unit is arranged below the photosensitive drum 1 in the drawing.

Figure 1:
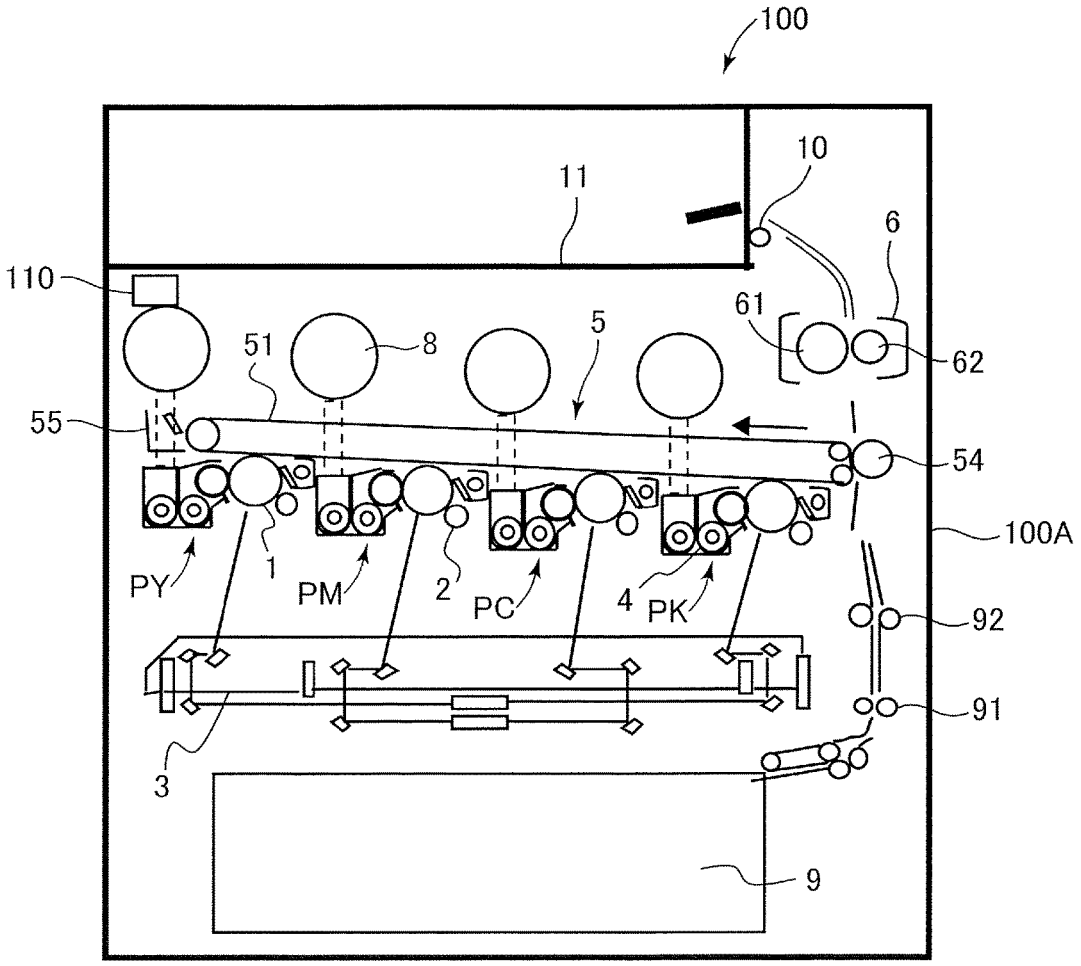
FIG. 1 is a schematic configuration diagram illustrating a configuration of an image forming apparatus adopting a developing apparatus according to a present embodiment.

An intermediate transfer apparatus 5 is arranged above the image forming portions in FIG. 1. The intermediate transfer apparatus 5 is configured such that an endless intermediate transfer belt 51 is stretched around a plurality of rollers and driven in the direction of the arrow. As described later, the intermediate transfer belt 51 bears and conveys a toner image primarily transferred thereto. As illustrated in FIG. 2, a secondary transfer roller 54 serving as a secondary transfer portion is arranged at a position facing a roller 53 across which the intermediate transfer belt 51 is stretched with the intermediate transfer belt 51 intervened, and it constitutes a secondary transfer portion T2 where the toner image on the intermediate transfer belt 51 is transferred to the recording material. As illustrated in FIG. 1, a fixing unit 6 is arranged downstream in a conveyance direction of the recording material of the secondary transfer portion T2.

A cassette 9 storing a recording material is arranged below the image forming apparatus 100. The recording material fed from the cassette 9 is conveyed by a conveyance roller 91 toward a registration roller 92. A leading edge of the recording material abuts against the registration roller 92 in a stopped state and a loop is formed, by which skew feed of the recording material is corrected. Thereafter, the registration roller 92 is started to be rotated to be synchronized with the conveyance of the toner image on the intermediate transfer belt 51, and the recording material is conveyed to the secondary transfer portion T2.

A process of forming a full four-color image by the image forming apparatus 100 configured as above will be described. When an image forming operation is started, at first, a surface of the photosensitive drum 1 being rotated is charged uniformly by the charging device 2. Thereafter, the photosensitive drum 1 is scan-exposed by laser beam corresponding to image signals outputted from the laser scanner 3. Thereby, an electrostatic latent image corresponding to the image signal is formed on the photosensitive drum 1. The electrostatic latent image on the photosensitive drum 1 is visualized by toner stored in the developing apparatus 4 and formed into a visible image.

The toner image formed on the photosensitive drum 1 is primarily transferred to the intermediate transfer belt 51 at a primary transfer portion T1 formed between the photosensitive drum 1 and the primary transfer roller 52 with the intermediate transfer belt 51 intervened. In this state, a primary transfer bias is applied to the primary transfer roller 52. Toner and other attachments remaining on the surface of the photosensitive drum 1 after primary transfer is removed by the cleaning device 7.

This operation is sequentially performed in the respective image forming portions of yellow, magenta, cyan and black, and the toner images of four colors are sequentially superposed on each other on the intermediate transfer belt 51. Thereafter, the recording material stored in the cassette 9 is conveyed to the secondary transfer portion T2 at a matched timing with the arrival (formation) of the toner image to the secondary transfer portion T2. By applying a secondary transfer bias to the secondary transfer roller 54, the four-color toner image on the intermediate transfer belt 51 is collectively secondary transferred to the recording material. Toner and other attachments remaining on the intermediate transfer belt 51 without being transferred at the secondary transfer portion T2 are removed by an intermediate transfer belt cleaner 55 illustrated in FIG. 1.

Next, the recording material is conveyed to the fixing unit 6. The fixing unit 6 includes a fixing roller 61 and a pressing roller 62, and the fixing roller 61 forms a fixing nip portion with the pressing roller 62. The fixing roller 61 can be a film or a belt, and the pressing roller 62 can be a belt. In a state where recording material on which the toner image is transferred is passed through the fixing nip portion, the recording material is heated and pressed. The toner on the recording material is melted, mixed and fixed as full-color image on the recording material. Thereafter, the recording material is discharged by a sheet discharge roller 10 onto the sheet discharge tray 11. Thereby, a series of image forming processes is ended.

According to the image forming apparatus 100 of the present embodiment, a one-color or multi-color image using one or more colors among the four colors, such as a black-colored image, can be formed.

Developing Apparatus

The developing apparatus 4 according to the present embodiment will be described with reference to FIGS. 2 through 4. As illustrated in FIG. 2, the developing apparatus 4 includes a developer container 41 storing a two-component developer including a nonmagnetic toner and a magnetic carrier (hereinafter simply referred to as developer). In the initial state of the developing apparatus 4, the amount of developer stored in the developer container 41 is 200 g, for example, but the amount of developer in the developer container increases or decreases along with the developing operation of the developing apparatus 4.

In the developer container 41, the portion of the developing area facing the photosensitive drum 1 is opened, and a developing sleeve 44 is disposed rotatably with a portion thereof exposed to the opening. A magnet roll 50 having a plurality of magnetic poles along the circumferential direction is arranged non-rotatably in the developing sleeve 44. The developing sleeve 44 is formed of a nonmagnetic material, and during developing operation, it rotates in a direction of the arrow of FIG. 2, bears the developer in the developer container and conveys the developer to the developing area.

The developing apparatus 4 includes a developing chamber 41*a* serving as a second chamber and an agitating chamber 41*b* serving as a first chamber, which are configured to store developer in the developer container, and the developing chamber 41*a* together with the agitating chamber 41*b* forms a circulation path through which developer is circulated. An inner side of the developer container 41 is divided into the developing chamber 41*a* and the agitating chamber 41*b* by a partition wall 41*c*, wherein the developing chamber 41*a* and the agitating chamber 41*b* are communicated by communication ports 41*f* and 41*g*, as illustrated in FIG. 3. The communication ports 41*f* and 41*g* are formed on both end portions in the longitudinal direction of the partition wall 41*c* (right and left ends in FIG. 3) so as to deliver developer between the developing chamber 41*a* and the agitating chamber 41*b*.

Figure 3:
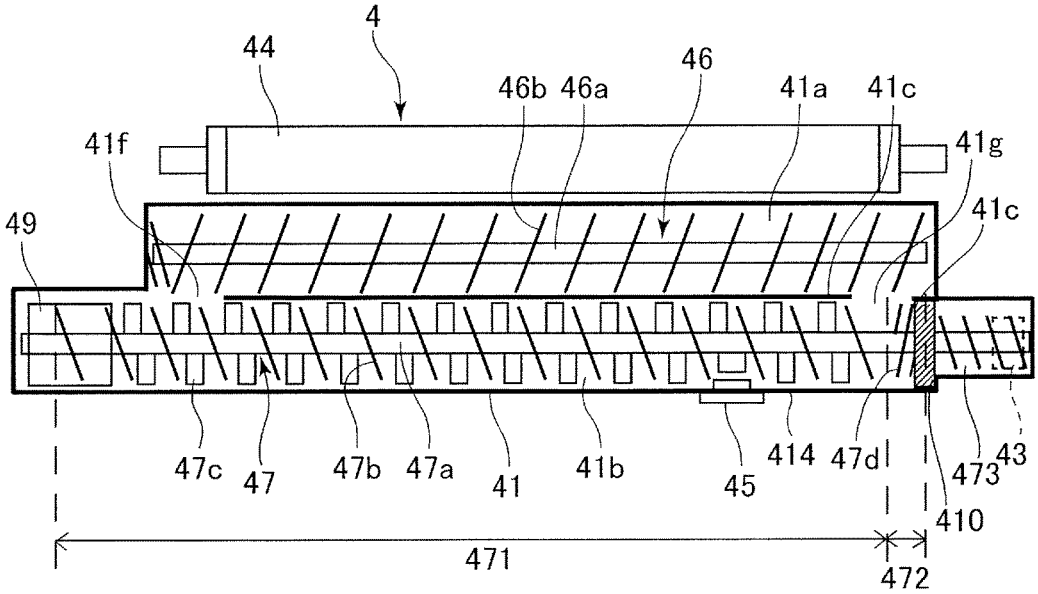
FIG. 3 is a cross-sectional view illustrating a developing apparatus according to a first embodiment from an upper side with a portion thereof omitted.

As illustrated in FIG. 3, a first conveyance screw 47 and a second conveyance screw 46 conveying developer are respectively provided in the developing chamber 41*a* and the agitating chamber 41*b*. Specifically, the second conveyance screw 46 is arranged in the developing chamber 41*a* and the first conveyance screw 47 is arranged in the agitating chamber 41*b*. The first conveyance screw 47 and the second conveyance screw 46 are respectively resin screws in which helical blades, i.e., fins, 47*b* and 46*b* are disposed around rotation shafts 47*a* and 46*a*.

First Conveyance Screw

A reverse-winding blade 47*d* that conveys developer to an opposite direction as the blade 47*b* is provided on the first conveyance screw 47. That is, the first conveyance screw 47 includes a conveyance screw 471 serving as a conveyance portion to which the blade 47*b* is formed and a return screw 472 serving as a return conveyance portion to which the blade 47*d* is formed. In the return screw 472, if the pitch of the blade 47*d* is set smaller than the pitch of the blade 47*b* of the conveyance screw 471 such that the number of blades, i.e., number of fins, per unit length is increased, the force pushing back the developer can be increased further. Moreover, amount of developer discharged through a discharge port 43, i.e., amount of discharge, can be adjusted by varying a length in the rotational axis direction of the return screw 472, and in the present embodiment, the length is set to 24 mm.

Further, a rib 47*c* that protrudes in a radial direction is provided on the conveyance screw 471 at least at a position opposing to an inductance sensor 45 that detects toner density of developer among the plurality of pitches of the blade 47*b*. In the present embodiment, the ribs 47*c* are provided at portions excluding both end portions of the conveyance screw 471. That is, the conveyance screw 471 includes the blade 47*b* and the ribs 47*c* serving as a plurality of projections having different developer conveying ability in the circumferential direction. The rib 47*c* uniformizes the toner density of developer by agitating developer in the circumferential direction of the conveyance screw 471 along with the rotation of the first conveyance screw 47.

The developing sleeve 44, the first conveyance screw 47 and the second conveyance screw 46 are arranged mutually in parallel, and also parallel to a rotational axis direction of the photosensitive drum 1. The developing sleeve 44, the first conveyance screw 47 and the second conveyance screw 46 are driven to rotate by a developing motor (not shown). For example, the first conveyance screw 47 and the second conveyance screw 46 are both rotated at a rotational speed of 680 rpm. The developer in the developing chamber 41*a* is moved from right to left in FIG. 3, i.e., second direction, while being agitated by the rotating second conveyance screw 46 and delivered to the agitating chamber 41*b* through a communication port 41*f* serving as a second communication port. Meanwhile, the developer in the agitating chamber 41*b* moves from left to right in FIG. 3, i.e., first direction, while being agitating by the rotating conveyance screw 471 and delivered to the developing chamber 41*a* through a communication port 41*g* serving as a first communication port. Thus, the developer is circulated and conveyed in the developer container while being agitated by two screws, the first conveyance screw 47 and the second conveyance screw 46. In the present embodiment, the first conveyance screw 47 is arranged such that an upstream end in the first direction of the return screw 472 is overlapped with the first communication port 41*g*. Thereby, developer can be delivered smoothly through the first communication port 41*g*.

The developer conveyed in the developing chamber 41*a* is supplied by the second conveyance screw 46 to the developing sleeve 44, as illustrated in FIG. 2. A predetermined amount of developer supplied to the developing sleeve 44 is borne on the developing sleeve 44 by magnetic field of the magnet roll 50, by which a developer reservoir is formed. By the rotation of the developing sleeve 44, layer thickness of developer attached to the developing sleeve 44 after passing the developer reservoir is regulated by a regulation member 42, and the developer is conveyed to a developing area opposed to the photosensitive drum 1.

In the above-described developing area, developer on the developing sleeve 44 is raised in a brush and forms a magnetic brush. By having the magnetic brush contact the photosensitive drum 1 and supply toner in the developer to the photosensitive drum 1, the electrostatic latent image on the photosensitive drum 1 is developed as a toner image. Further, in order to improve developing efficiency, that is, to improve attachment rate of toner to the electrostatic latent image, a developing bias in which DC voltage and AC voltage are superposed is applied to the developing sleeve 44. The developer on the developing sleeve 44 after supplying toner to the photosensitive drum 1 returns to the developing chamber 41*a* by further rotation of the developing sleeve 44.

As illustrated in FIG. 3, the discharge port 43 through which a portion of developer, i.e., excessive developer, in the developer container is discharged is formed on a downstream end side in the first direction (right end portion of FIG. 3) of the conveyance screw 471 in the agitating chamber 41*b*. The return screw 472 mentioned earlier is provided downstream of the conveyance screw 471 and upstream of the discharge port 43 in the first direction and conveys the developer to an opposite direction as the conveyance screw 471. Thus, the developer conveyed in the agitating chamber 41*b* and moving beyond the return screw 472 is discharged through the discharge port 43. The discharge port 43 is formed on a bottom surface of the developer container 41, and the developer falling through the discharge port 43 is discharged to the exterior of the developer container. The developer discharged from the discharge port 43 is recovered in a recovery container not shown.

Meanwhile, a replenishing port 49 configured to receive developer for replenishment (hereinafter referred to as replenisher) supplied from a replenishing device 8 (refer to FIG. 1) is provided on an upstream end portion (left end portion of FIG. 3) in the first direction of the conveyance screw 471 in the agitating chamber 41*b*. As illustrated in FIG. 1, the replenishing device 8 is arranged above the developing apparatuses 4 of the respective image forming portions and configured to replenish developer respectively to the developing apparatuses 4 of the respective image forming portions. In the present embodiment, the replenishing device 8 stores a replenisher containing toner and carrier. As the replenisher, developer having mixed toner and carrier at a 9 to 1 ratio by weight is used. The replenishing device 8 replenishes the replenisher according to an amount of toner consumption used during image forming or toner density detected by the inductance sensor 45 (refer to FIG. 3), by arbitrarily rotating a replenishing screw not shown, for example.

The replenisher replenished to the agitating chamber 41*b* is conveyed in the agitating chamber 41*b* while being agitated by the conveyance screw 471 with developer conveyed from the developing chamber 41*a*. Excessive developer caused by replenishment of the replenisher is discharged through the discharge port 43, as described earlier. At the same time, deteriorated carrier is also discharged. That is, the present embodiment involves the developing apparatus 4 adopting an ACR configuration in which replenisher highly containing toner is replenished from the replenishing device 8, and excessive developer highly containing deteriorated carrier is discharged through the discharge port 43.

In the present embodiment, a discharge screw 473 is provided downstream in the first direction of the return screw 472 in the first conveyance screw 47. The discharge screw 473 conveys the developer having moved beyond the return screw 472 to the first direction, to thereby discharge developer efficiently through the discharge port 43.

Figure 14:
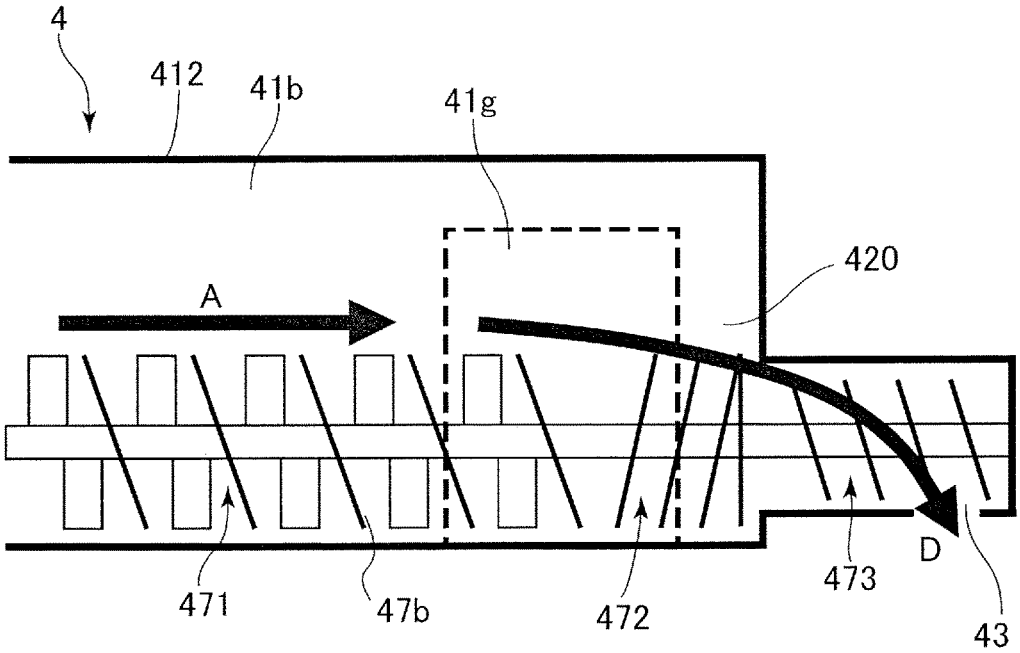
FIG. 14 is a schematic diagram illustrating a vicinity of a first communication port of a conventional developing apparatus viewed from the agitating chamber side.

In the conventional developing apparatus, as described earlier, developer is discharged not only in a case where the amount of developer in the developer container is increased by the replenishment of the replenisher, but also in a case where there is only a small amount of developer in the developer container. One example of the conventional developing apparatus is illustrated in FIG. 14. FIG. 14 illustrates a vicinity of a first communication port viewed from the agitating chamber side.

In the case of the conventional developing apparatus, as illustrated in FIG. 14, the blade 47*b* of the conveyance screw 471 is exposed from the developer if the amount of developer is small, and the developer tends to be flipped up in the gravity direction by the rotating blade 47*b*. As the rotational speed of the conveyance screw 471 increases, the more easily the developer tends to flip up. If the blade 47*b* is exposed from the developer, air is pressed by the blade 47*b* along with the rotation, and air is flown toward the first direction in the agitating chamber 41*b*, by which airflow A is generated. The intensity of airflow A, i.e., airflow quantity, increases as the rotation speed of the conveyance screw 471 increases, in proportion to the rotational speed. Further, if the distance between an upper wall portion 412 of the developer container and the conveyance screw 471 is wide, that is, if there is a wide space above the conveyance screw 471, a greater amount of air is involved to generate the above-mentioned airflow A.

A portion of the airflow A passes the first communication port 41*g* and flows from the agitating chamber 41*b* toward the developing chamber 41*a* (refer to FIG. 2), but most of the airflow A does not flow to the developing chamber 41*a*, and instead, flows toward the discharge port 43 through a discharge space 420 on a downstream side in the first direction of the first communication port 41*g* (airflow D). The discharge space 420 is a space ensured above the return screw 472 and communicated to the discharge port 43 in the agitating chamber 41*b*, through which developer to be discharged through the discharge port passes. The developer flipped up by the blade 47*b* and conveyed by the above-mentioned airflow A, i.e., airflow D, toward the downstream side in the first conveyance direction moves beyond the return screw 472, conveyed toward the discharge port by the discharge screw 473 and discharged.

As described, if airflow is generated as in the conventional case, developer will be discharged little by little even if there is only a small amount of developer in the developer container. Therefore, the amount of developer in the developer container will become too small, and image defects such as a portion of an image missing may be caused due to the lack of supply of developer to the developing sleeve 44. However, considering the fact that developer is conveyed by rotating the conveyance screw 471, the above-described airflow occurs inevitably. Therefore, in the present embodiment, assuming that airflow is generated along with the rotation of the conveyance screw 471, the developing apparatus 4 is configured to prevent the developer from being easily discharged through the discharge port 43 even if the developer is conveyed by airflow. This configuration of the developing apparatus 4 will be described with reference to FIGS. 3 through 11.

Partition Member

In the developing apparatus 4 of the present embodiment, a flat plate-shaped partition member 410 is provided in the agitating chamber 41*b*. As illustrated in FIG. 3, the partition member 410 is formed transversely and continuously from the partition wall 41*c* to an opposing wall portion 414 of the developer container 41 opposite to the partition wall 41*c* with respect to a direction intersecting a rotational axis direction of the first conveyance screw 47.

Figure 4:
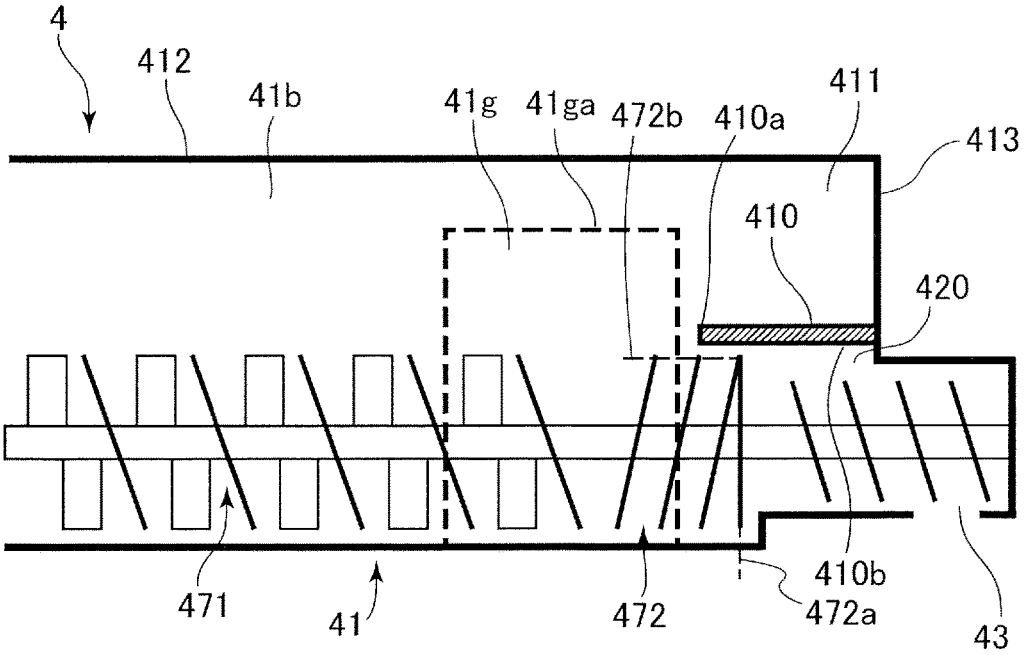
FIG. 4 is a schematic diagram illustrating a vicinity of a first communication port when the developing apparatus according to the first embodiment is viewed from an agitating chamber side.

As illustrated in FIG. 4, the partition member 410 is extended toward an upstream side in the first direction from a wall portion, i.e., side wall portion 413, on a downstream side in the first direction of the developer container 41 with respect to the rotational axis direction of the first conveyance screw 47. The partition member 410 is extended from the side wall portion 413 to a position corresponding to a downstream end 472*a* in the first direction of the return screw 472 or to a position further upstream beyond the downstream end 472*a* in the first direction of the return screw 472. According to the present embodiment, a distal end 410*a* of the partition member 410 is positioned to oppose to the return screw 472. Specifically, the partition member 410 is extended such that the distal end 410*a* is positioned at a distance of 10 to 13 mm toward the upstream side from the downstream end 472*a* in the first direction of the return screw 472 set as reference.

Further, the partition member 410 is arranged downward in a gravity direction than an upper end portion 41*ga* of the first communication port 41*g*. Preferably, the partition member 410 is arranged such that a gap of 1 mm or greater and 3 mm or smaller is formed between a bottom surface 410*b* thereof and an uppermost end portion 472*b* of the return screw 472. The gap between the bottom surface 410*b* of the partition member 410 and the uppermost end portion 472*b* of the return screw 472 should preferably be narrow.

The partition member 410 should preferably be formed such that there is no gap between the partition member 410 and each of the opposing wall portion 414, the side wall portion 413 and the partition wall 41*c*. By providing such partition member 410 across the agitating chamber 41*b*, a dead-end space 411 is formed above the discharge space 420 which is communicated with the discharge port 43 at a downstream side in the first direction than the return screw 472. In other words, by extending the partition member 410, the discharge space prior to having the agitating chamber 41*b* divided by the partition member 410 is divided into two, lower and upper, spaces in the gravity direction, which serves as the discharge space 420 having a narrower space than before division and the dead-end space 411.

Figure 5:
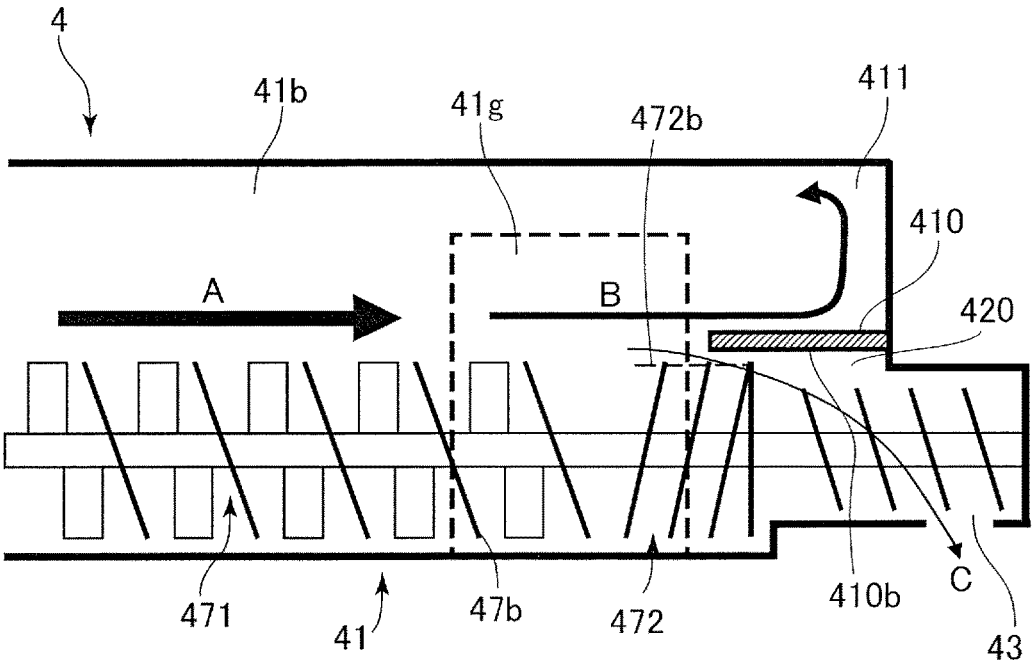
FIG. 5 is a schematic diagram illustrating an airflow that is generated by rotation of a screw.

As illustrated in FIG. 5, also according to the present embodiment, airflow A toward the first direction is generated along with the rotation of the conveyance screw 471, and the developer flipped up by the blade 47*b* is conveyed by airflow A toward the downstream side in the first conveyance direction. Since the agitating chamber 41*b* is divided into the discharge space 420 and the dead-end space 411 by the partition member 410, airflow A is divided into a main airflow B flowing toward the dead-end space 411 and airflow C flowing toward the discharge space 420. That is, according to the present embodiment, a gap (of 1 mm, for example) is formed between the bottom surface 410*b* of the partition member 410 and the uppermost end portion 472*b* of the return screw 472, so as to prevent mutual interference. Therefore, a portion of airflow A flows through the gap as airflow C, but most of airflow A is flown upward of the partition member 410 as airflow B by providing the dead-end space 411. Then, airflow B flowing toward the dead-end space 411 is reversed in the dead-end space 411, and developer contained in airflow B may fall on an upper surface of the partition member 410 in the dead-end space 411. That is, developer contained in airflow B flowing toward the dead-end space 411 will not flow past the return screw 472 due to the partition member 410, so that discharge of developer through the discharge port 43 that occurs by airflow generated by the rotation of the conveyance screw 471 may be suppressed.

Figure 6:
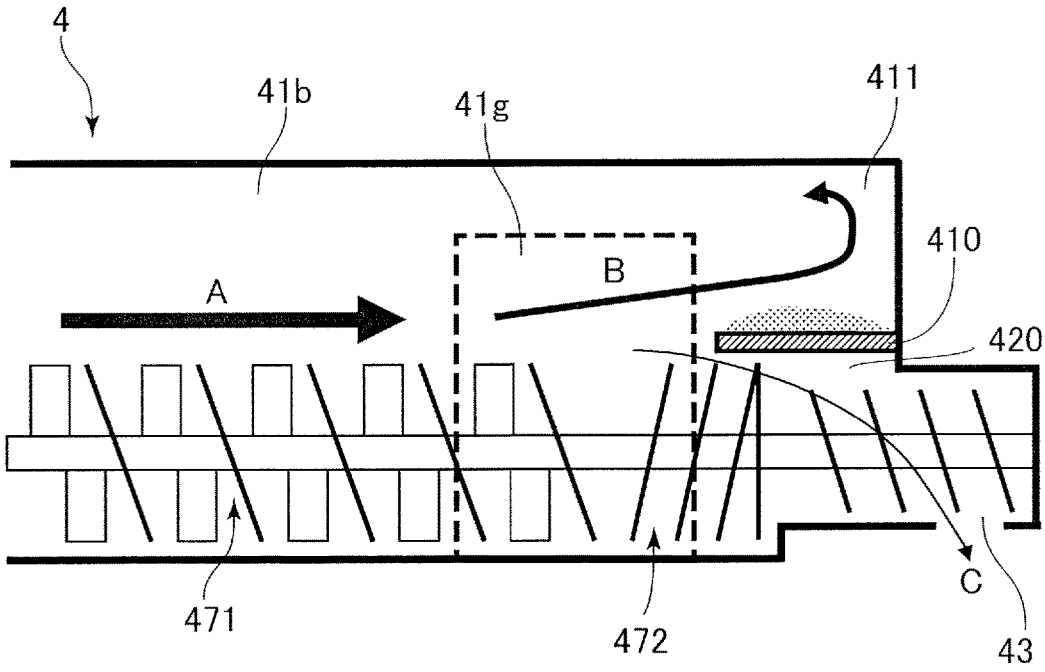
FIG. 6 is a schematic diagram illustrating a case where a small amount of developer is accumulated on a partition member.
Figure 7:
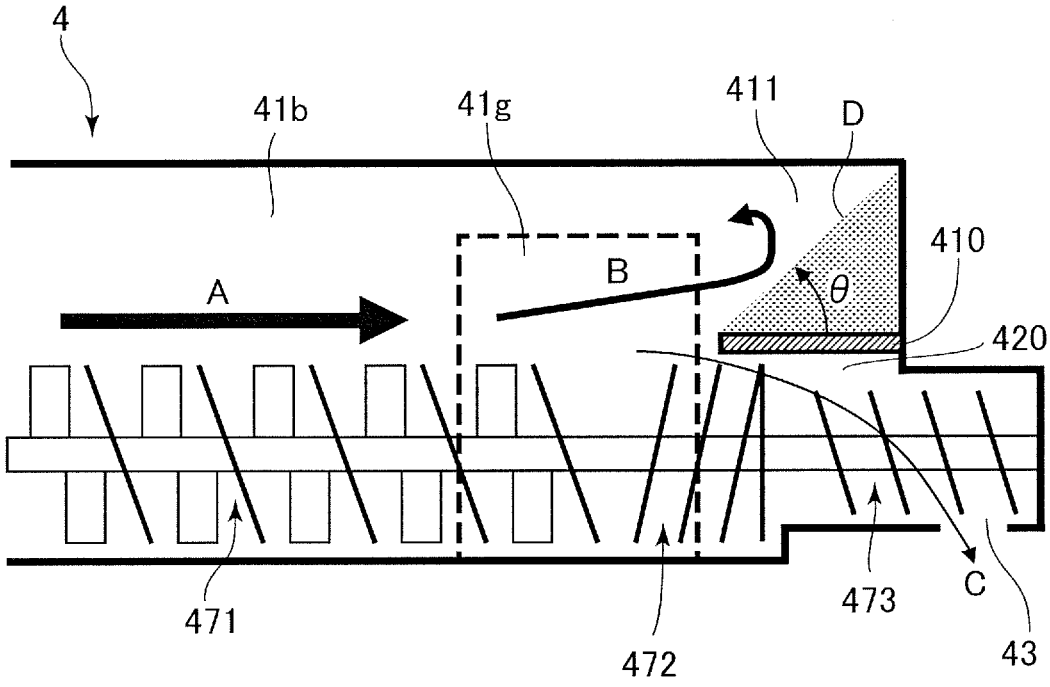
FIG. 7 is a schematic diagram illustrating a case where a large amount of developer is accumulated on the partition member.

According to the present embodiment, developer contained in airflow B will fall on the upper surface of the partition member 410 in the dead-end space 411, so that developer conveyed by airflow B is accumulated on the upper surface of the partition member 410, as illustrated in FIG. 6. If developer accumulated on the upper surface of the partition member 410 is increased, surface height of the developer becomes higher on the downstream side than on the upstream side in the first direction, as illustrated in FIG. 7. The accumulated developer collapses after exceeding an angle of repose θ and falls downward in the gravity direction from the partition member 410. However, the developer falls on the return screw 472. The partition member 410 is designed to realize such operation. The developer falling from the partition member 410 will be conveyed by the return screw 472 in the second direction, so that it is difficult for the developer to be conveyed beyond the return screw 472, by the discharge screw 473 toward the discharge port 43 and discharged.

Figure 8:
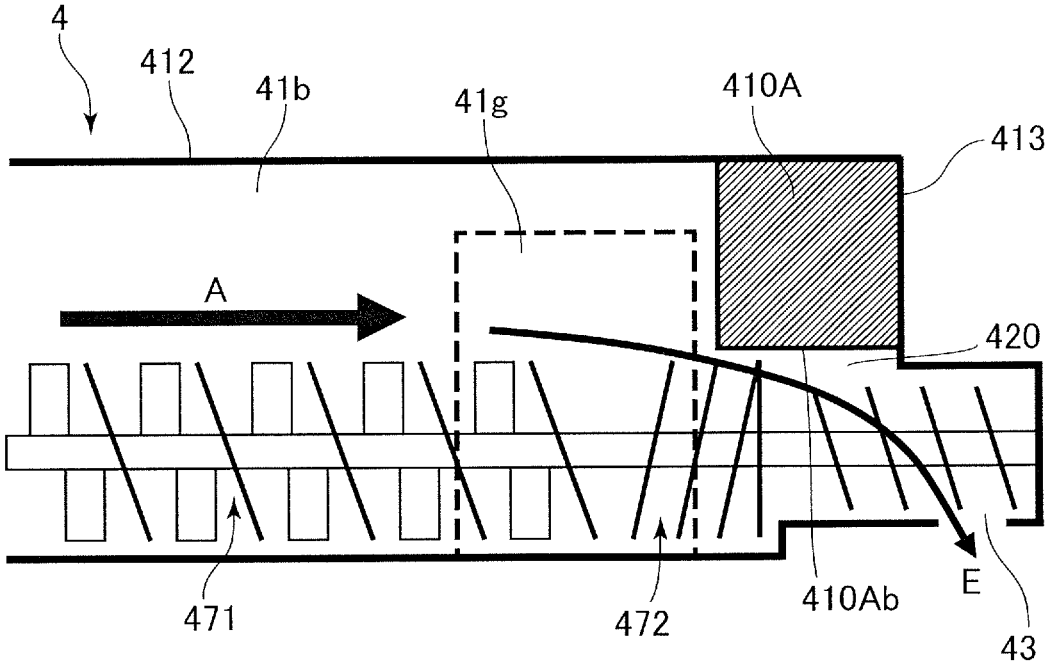
FIG. 8 is a schematic diagram illustrating a comparative example where a dead-end space is not formed.

FIG. 8 is a comparative example of a case where a partition member 410A having a high height is provided so as to fill the dead-end space 411 according to the present embodiment illustrated in FIG. 5. In the comparative example of FIG. 8, most of airflow A is flown toward the gap between the partition member 410A and the return screw 472 as airflow E. In the case of the comparative example, developer contained in airflow A exceeds the return screw 472 through the discharge space 420 narrowed by the partition member 410A, so that developer is easily discharged through the discharge port 43 compared to the first embodiment described earlier (refer to FIG. 5). The other configurations and operations are similar to the above-described first embodiment.

Distal End Position of Partition Member

As described earlier, the distal end 410*a* of the partition member 410 is positioned at a distance of 10 to 13 mm on the upstream side from the downstream end 472*a* in the first direction of the return screw 472 set as reference. The reason for this arrangement will be described.

The present inventors have carried out a test to examine discharge characteristics of developer, mainly carrier, from the discharge port 43. We have performed tests of a case where the amount of developer in the developer container is a lower limit value (190 g) of a proper range that does not cause image defects, erroneous detection of toner density or leakage of developer, and a case where the amount is an upper limit value (220 g) of the proper range. Further, we have carried out tests by positioning the distal end 410*a* of the partition member 410 at distances of 2 mm, 10 mm, 13 mm and 15 mm toward the upstream side from the downstream end 472*a* in the first direction of the return screw 472, i.e., reference position (refer to FIG. 4). The test results are shown in FIGS. 9A and 9B.

Figure 9A:
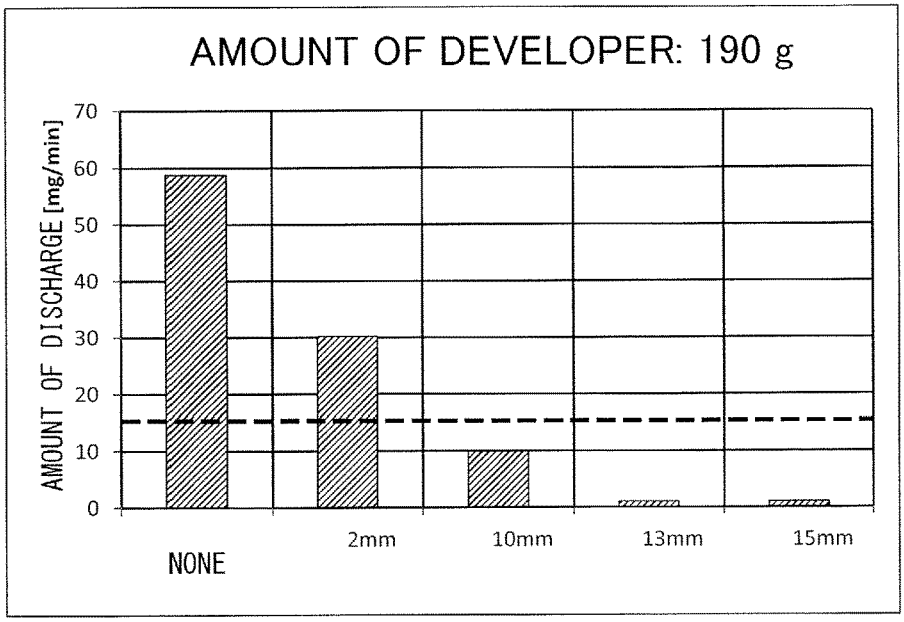
FIG. 9A is a graph illustrating a relationship between position of a distal end of the partition member and an amount of discharge of carrier, in a case where amount of developer in the developer container is a lower limit value.
Figure 9B:
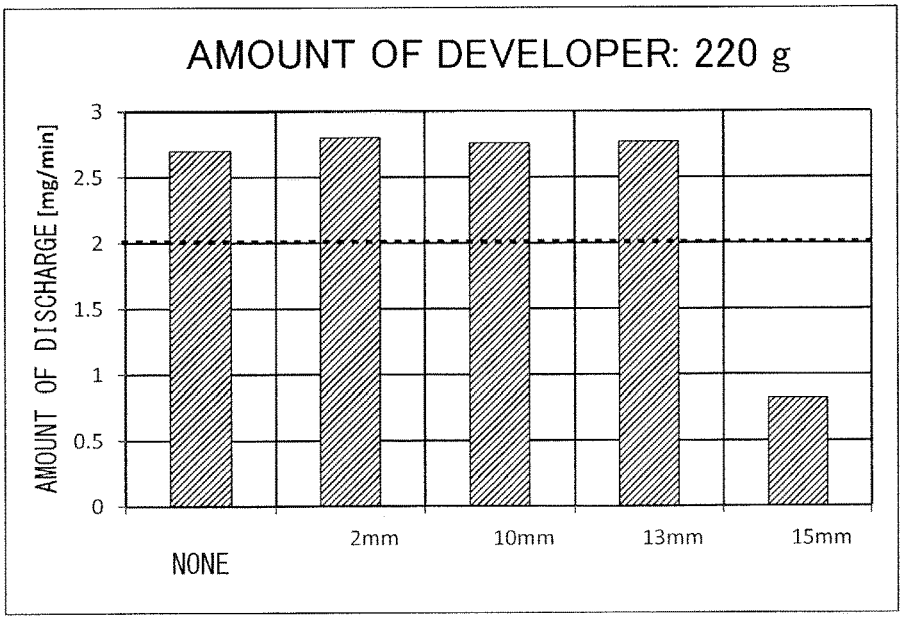
FIG. 9B is a graph illustrating a relationship between position of a distal end of the partition member and an amount of discharge of carrier, in a case where the amount of developer in the developer container is an upper limit value.

FIG. 9A illustrates an amount of discharge of carrier per unit time of a case where the amount of developer is the lower limit value, and FIG. 9B illustrates an amount of discharge of carrier per unit time of a case where the amount of developer is the upper limit value. For comparison, a test result using a conventional apparatus without the partition member 410 is shown (left end in the drawing: NONE). In FIG. 9A, a minimum amount of carrier replenishment per minute (which in this case is 15 mg) calculated based on minimum amount of toner consumption per minute in a state where rotational speed is 70 ppm is illustrated by a dotted line. In FIG. 9B, a maximum amount of carrier replenishment per minute (which in this case is 2 g) calculated based on maximum amount of toner consumption per minute in a state where rotational speed is 70 ppm is illustrated by a dotted line. In order to keep the amount of developer in the proper range, if the amount of developer is the lower limit value, it is necessary to set the amount of discharge of carrier per unit time to be smaller than the minimum amount of carrier replenishment per unit time. Meanwhile, if the amount of developer is the upper limit value, it is necessary to set the amount of discharge of carrier per unit time to be greater than the maximum amount of carrier replenishment per unit time.

As illustrated in FIG. 9A, if the amount of developer is the lower limit value, the amount of discharge of carrier is reduced compared to the conventional configuration as the position of the distal end 410*a* of the partition member 410 becomes distant from the reference position (from 2 mm to 15 mm), and the amount of discharge of carrier becomes approximately fixed if the position of the distal end 410*a* becomes distant beyond a certain distance (for example, 13 mm). This is because if the range of area in which the partition member 410 covers the return screw 472 is narrow, airflow C tends to flow more easily through the gap between the partition member 410 and the return screw 472 compared to the case where the range of area in which the partition member 410 covers the return screw 472 is wide (refer to FIG. 5). In other words, if airflow C tends to flow more easily, it becomes relatively difficult for airflow A to be diverted to airflow B, and the developer, i.e., carrier, accumulated on the partition member 410 is reduced, while the developer, i.e., carrier, carried beyond the return screw 472 and discharged through the discharge port 43 is increased.

Meanwhile, as illustrated in FIG. 9B, if the amount of developer is an upper limit value, the amount of discharge of carrier is approximately fixed in a case where the position of the distal end 410*a* of the partition member 410 is within the range of 13 mm from the reference position. The amount of discharge is reduced extremely to even fall below the maximum amount of carrier replenishment at a distance of 15 mm from the reference position. This is because if the amount of developer is the upper limit value, the distal end 410*a* of the partition member 410 will be buried in the developer if the position of the distal end 410*a* of the partition member 410 is farther than 13 mm.

Figure 10:
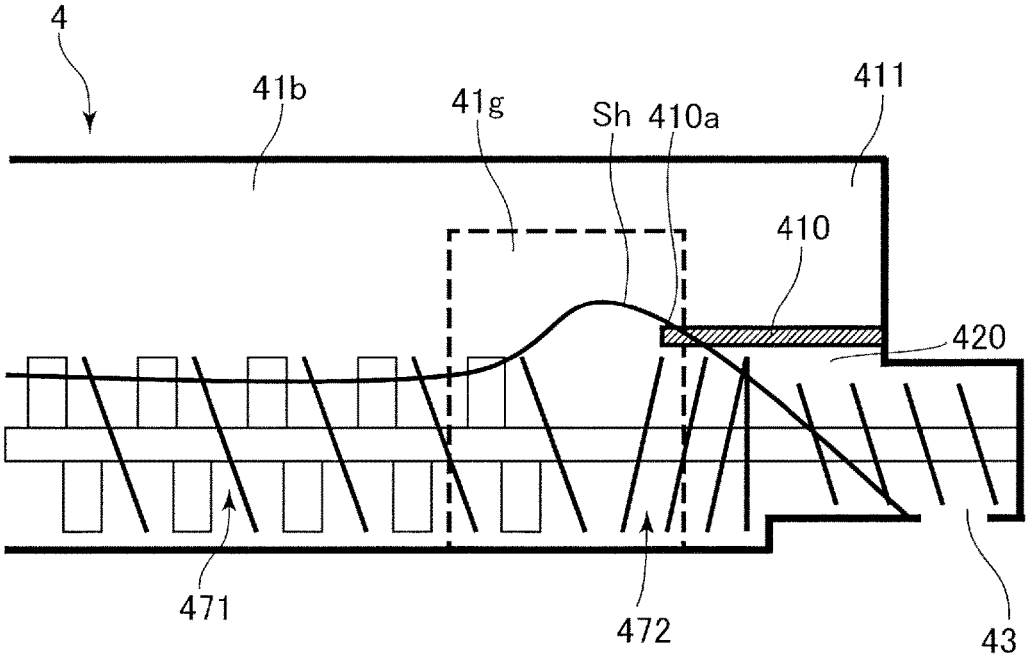
FIG. 10 is a schematic diagram illustrating a position of a distal end of the partition member.

FIG. 10 illustrates a developer surface height Sh in the vicinity of the return screw 472 in the agitating chamber 41*b* in a case where the amount of developer is the upper limit value. If the developer conveyed in the first direction by the conveyance screw 471 collides against the developer conveyed in the second direction by the return screw 472, a peak of the developer surface height Sh occurs between the conveyance screw 471 and the return screw 472 along the rotational axis direction. If the position of the distal end 410*a* of the partition member 410 is positioned further away from the reference position, in other words, if the distal end 410*a* is positioned closer to the upstream end of the return screw 472, the distal end 410*a* may be buried in the developer, as illustrated in FIG. 10. If the distal end is buried, even though there is a large amount of developer and developer should be discharged through the discharge port 43, the partition member 410 makes it difficult for the developer to move beyond the return screw 472, that is, the partition member 410 obstructs the flow of developer. As a result, if the amount of developer is the upper limit value, the amount of discharge of carrier through the discharge port 43 will be reduced significantly if the position of the distal end 410*a* of the partition member 410 is farther than 13 mm. In that case, the amount of developer in the developer container may exceed the proper range.

Figure 11:
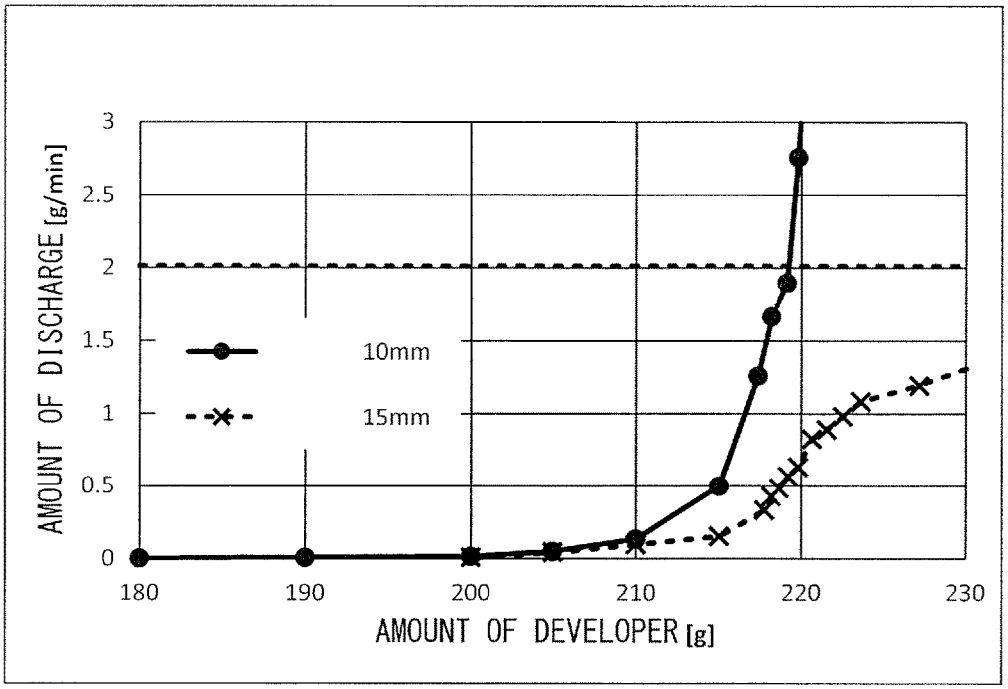
FIG. 11 is a graph illustrating a relationship between an amount of developer in the developer container and an amount of discharge of carrier comparing cases where a position of a distal end of the partition member is set at distances of 10 mm and 15 mm from a reference position.

FIG. 11 illustrates discharge characteristics of developer, mainly carrier, of cases where the distal end 410*a* of the partition member 410 is set to positions at distances of 10 mm and 15 mm from the reference position. As illustrated in FIG. 11, if the amount of developer is the above-described lower limit value (190 g), the amount of discharge of carrier is almost the same for both cases where the distal end 410*a* is positioned at distances of 10 mm and 15 mm from the reference position. However, as the amount of developer approximates the upper limit value (220 g), the amount of discharge of carrier is varied greatly between cases where the distal end 410*a* is positioned at a distance of 10 mm and at a distance of 15 mm from the reference position. That is, if the distal end 410*a* is at a distance of 10 mm from the reference position, the amount of discharge of carrier is increased significantly as the amount of developer increases. Meanwhile, if the distal end 410*a* is at a distance of 15 mm from the reference position, the amount of discharge of carrier is increased gradually as the amount of developer increases, compared to the case where the distal end 410*a* is at a distance of 10 mm. This is because in the case where the amount of developer is the upper limit value, if the distal end 410*a* is positioned at a distance of 15 mm from the reference position, the flow of developer is obstructed by the partition member 410 and the amount of discharge of carrier through the discharge port 43 is reduced significantly.

In view of the above-described characteristic, it is preferable that the distal end 410*a* of the partition member 410 is designed to be positioned at a distance of 10 to 13 mm toward the upstream side from the reference position. However, the position is not restricted to this example, and the position of the distal end 410*a* may be varied according to the rotational-axis direction length of the return screw 472, or the size of the gap between the return screw 472 and the partition member 410.

As described, according to the present embodiment, the partition member 410 is extended to cover a portion of the return screw 472 on the side of the agitating chamber 41*b* in which the discharge port 43 is formed. By providing the partition member 410, the agitating chamber 41*b* is divided into the discharge space 420 and the dead-end space (hereinafter also referred to as buffer space) 411. That is, by providing the partition member 410 to divide the space in the agitating chamber 41*b* serving as the first chamber in the gravity direction, the space is divided into the discharge space 420 communicated with the discharge port 43 that is positioned at the downstream side in the first direction than the return screw 472 serving as the return conveyance portion, and the dead-end space 411 that is only opened toward the upstream side in the first direction. The dead-end space 411 is opened toward the upstream side in the first direction but surrounded by the wall surfaces of the developer container 41 and the partition member 410, such that it is closed toward the downstream side in the first direction. Airflow A that occurs by the rotation of the conveyance screw 471 is split mainly into airflow B flowing toward the dead-end space 411 and airflow C flowing toward the discharge space 420 (refer to FIG. 5). Since the gap between the partition member 410 and the return screw 472 is narrow, most of airflow A flows above the partition member 410 (airflow B). The developer contained in airflow B falls on an upper surface of the partition member 410 in the dead-end space 411 and will not be conveyed beyond the return screw 472. As described, according to the present embodiment, discharge of developer through the discharge port 43 by airflow that occurs by the rotation of the conveyance screw 471 can be suppressed.

Second Embodiment

Figure 12:
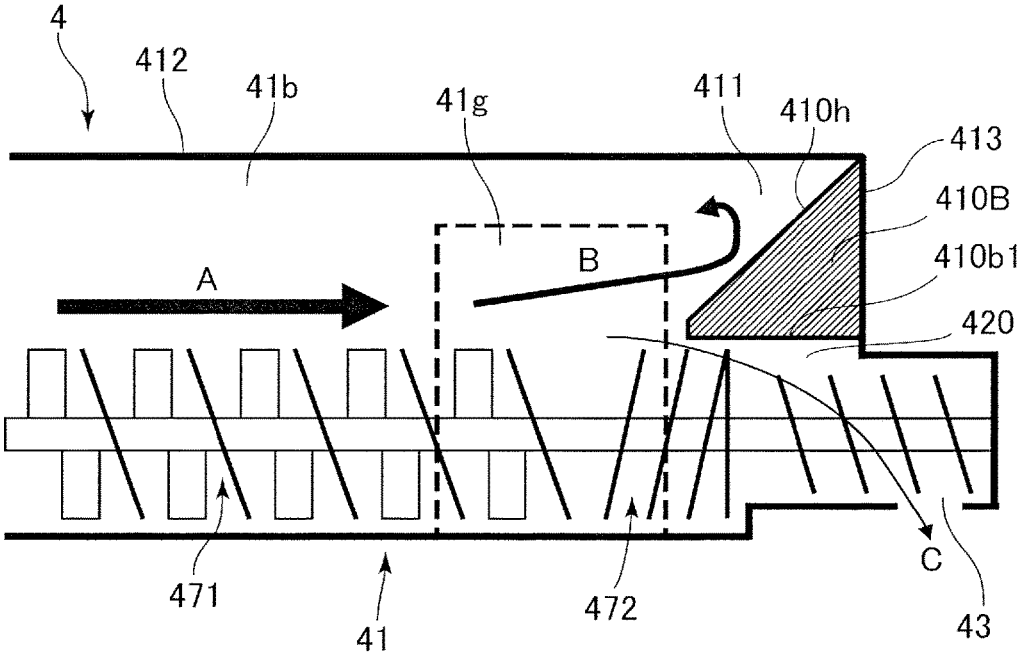
FIG. 12 is a schematic diagram illustrating a vicinity of a first communication port in a case where a developing apparatus according to a second embodiment is viewed from an agitating chamber side.

A second embodiment will now be described with reference to FIG. 12. According to the first embodiment described above, a configuration where a member formed in a flat plate-like shape is adopted as a partition member has been illustrated. According to the second embodiment, a configuration where a partition member 410B formed to have an inclined upper surface 410*h* is adopted, as illustrated in FIG. 12. Specifically, an upper surface 410*h* of the partition member 410B is formed in an inclined manner such that a distance between the upper surface 410*h* and the upper wall portion 412 of the developer container 41 is narrowed from the upstream side toward the downstream side in the first direction. The upper surface 410*h* of the partition member 410B is formed to be inclined with a greater angle than the angle of repose (refer to θ of FIG. 7) of the developer with respect to the horizontal plane. Since the upper surface 410*h* of the partition member 410B is inclined, it becomes possible to drop small amounts of developer to the return screw 472 before a large amount of developer accumulates on the upper surface 410*h*, while ensuring the dead-end space 411. Thus, falling of developer in large chunks from the upper surface 410*h* of the partition member 410B is prevented, and the amount of developer conveyed by the return screw 472 will not be increased temporarily. Thereby, discharge of developer caused by dropping of accumulated developer on the partition member 410B can be suppressed according to the present embodiment. Other configurations and operations are similar to the first embodiment. In the present embodiment, the upper end portion of the partition member 410B is positioned upward than the upper end portion of the first communication port 41*g*, but since the position of a bottom surface portion 410*b*1 of the partition member 410B determines the gap between the partition member 410B and the return screw 472, it is merely necessary for the partition member 410B to be designed such that at least the bottom surface portion 410*b*1 opposed to the first conveyance screw 47 is positioned lower than an upper end portion of the first communication port 41*g*. In other words, it is merely necessary for the surface of the partition member opposed to the first conveyance screw 47 to be positioned downward in the gravity direction than the upper end of the first communication port 41*g* and upward in the gravity direction than the first conveyance screw 47.

Third Embodiment

Figure 13A:
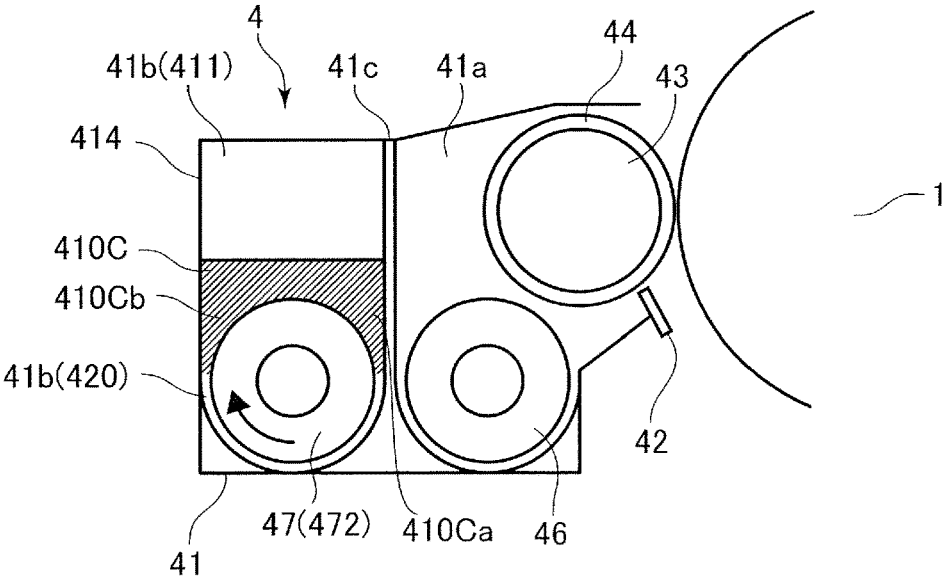
FIG. 13A is a schematic diagram illustrating a developing apparatus according to a third embodiment from a side with a portion thereof omitted, in a case where a partition wall-side block portion and an opposing wall portion-side block portion are provided.

A third embodiment will be described with reference to FIGS. 13A and 13B. In the first embodiment described earlier, a configuration has been illustrated of a case where a flat plate-shaped member is used as the partition member, and the partition member is arranged with a gap formed between the uppermost end portion 472*b* of the return screw 472. In contrast, according to the third embodiment, a partition member 410C having a partition wall-side block portion 410Ca and an opposing wall portion-side block portion 410Cb, as illustrated in FIG. 13A is adopted. The partition wall-side block portion 410Ca is formed to block a space intervened between the first conveyance screw 47 and the partition wall 41*c*, and the opposing wall portion-side block portion 410Cb is formed to block a space intervened between the first conveyance screw 47 and the opposing wall portion 414 of the developer container 41 positioned opposite to the partition wall 41*c*. In the present embodiment, a portion of a lower surface of the partition member 410C is formed into an arc shape having a curvature 1 mm greater than the radius of curvature of the return screw 472, such that there is a 1-mm-gap between the return screw 472.

As mentioned earlier, it is necessary to ensure a minimum gap (for example, 1 mm) between the partition member and the return screw 472 to avoid interference. However, if a flat plate-shaped member is used as the partition member (refer to FIG. 2), a gap of 1 mm or greater is formed in the space intervened between the first conveyance screw 47 and the partition wall 41*c* or in the space intervened between the first conveyance screw 47 and the opposing wall portion 414 of the developer container 41. In that case, the developer flipped by the screw and conveyed by airflow may easily pass through these spaces to move beyond the return screw 472 and be discharged through the discharge port 43. Therefore, by blocking the passage of airflow by the partition wall-side block portion 410Ca and the opposing wall portion-side block portion 410Cb as according to the present embodiment, discharge of developer through the discharge port 43 by airflow that occurs by the rotation of the screw conveying the developer can be suppressed even further. The other configurations and operations are similar to the first embodiment.

Figure 13B:
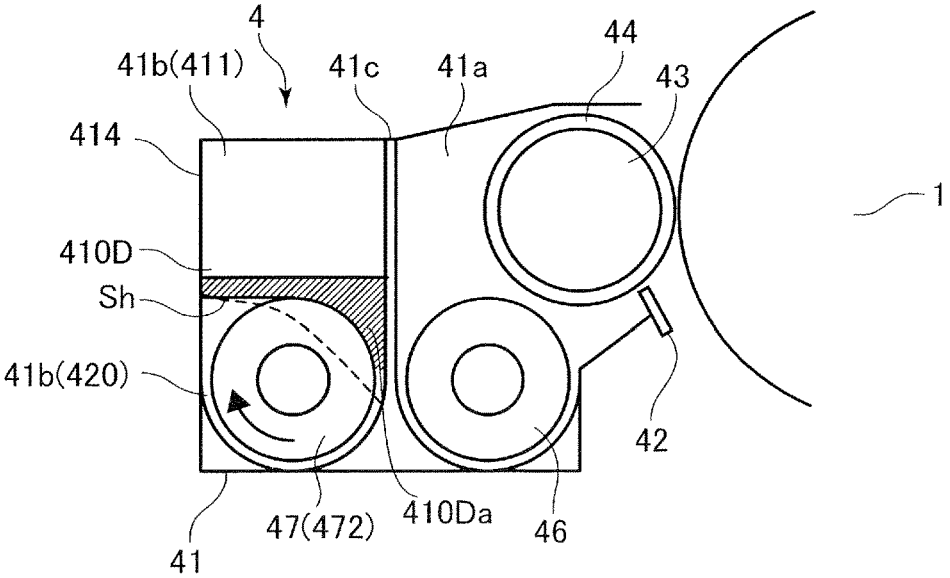
FIG. 13B is a schematic diagram illustrating a developing apparatus according to a third embodiment from a side with a portion thereof omitted, in a case where a partition wall-side block portion is provided.

Further, as illustrated in FIG. 13B, it is possible to adopt a configuration where a partition member 410D includes only a partition wall-side block portion 410Da. That is, if the direction of rotation of the return screw 472 is from down to up in the gravity direction at the side of the opposing wall portion 414, a developer surface height Sh of the developer will be lower at the partition wall 41*c* side and higher at the opposing wall portion 414 side. Therefore, if the gap on the opposing wall portion 414 side is blocked by the opposing wall portion-side block portion 410Cb according to the above-described partition member 410C, the opposing wall portion-side block portion 410Cb may obstruct the developer from being discharged if the amount of developer is increased. Therefore, a configuration is adopted where the partition member 410D includes only the partition wall-side block portion 410Da, which blocks the space intervened between the first conveyance screw 47 and the partition wall 41*c* to realize both discharge of developer if there is a large amount of developer and suppression of discharge of developer if there is a small amount of developer.

Other Embodiments

The partition member 410 may be formed as a separate member, instead of being formed integrally with the developer container 41. That is, the above-described dead-end space 411 can be formed by attaching an attachment portion formed in a shape arrangeable in the agitating chamber 41*b* and a partition forming member having an integrated plate-shaped member corresponding to the above-described partition member 410 in the agitating chamber 41*b*. Upon attaching the partition forming member in the agitating chamber 41*b*, for example, a sealing member composed of a Moltopren and the like may be intervened to prevent a gap from being formed between the plate-shaped member and any one/each of the opposing wall portion 414, the side wall portion 413 and the partition wall 41*c*.

According to the respective embodiments described above, the discharge port 43 is formed on the downstream side, in the first direction. of the agitating chamber 41*b*, but the present invention is not restricted to this example. The discharge port 43 may be formed on the downstream side, in the second direction, of the developing chamber 41*a*. In that case, the return screw is arranged on the downstream side in the second direction of the second conveyance screw 46, and the partition member 410 is extended to cover a portion of the second conveyance screw 46, or more specifically, the return screw, from the side wall portion on the downstream side in the second direction (refer to FIG. 3) of the developing chamber 41*a*.

The above-described embodiments were described taking a horizontal agitation-type developing apparatus as an example where the developing container 41 is divided horizontally into the developing chamber 41*a* and the agitating chamber 41*b*, but the present invention is not restricted to this example. For example, the present invention is also applicable to a vertical agitation-type developing apparatus where the developer container 41 is divided vertically into the developing chamber 41*a* and the agitating chamber 41*b*.

The above-described embodiments were described taking the intermediate transfer-type image forming apparatus 100 as an example where toner images of respective colors are primarily transferred from the respective photosensitive drums 1 corresponding to the respective colors to the intermediate transfer belt 51 before the superposed toner images of respective colors are collectively secondarily transferred to the recording material, but the present invention is not restricted to this example. For example, the above-described developing apparatus can be applied to a direct transfer-type image forming apparatus where images are directly transferred from the photosensitive drums to the recording material borne and conveyed on a transfer material conveyance belt.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-105063, filed May 26, 2017, which is hereby incorporated by reference wherein in its entirety.

What is claimed is:

1. A developing apparatus comprising:

a developer container comprising a first chamber in which a discharge port of developer is formed and a second chamber that forms a circulation path of developer with the first chamber;

a first conveyance screw disposed in the first chamber and comprising:

a conveyance portion configured to convey developer to a first direction toward the discharge port; and a return conveyance portion disposed upstream of the discharge port in the first direction and configured to convey developer conveyed by the conveyance portion in a second direction that is opposite to the first direction;

a partition wall configured to separate the first chamber and the second chamber in the developer container with first and second communication ports, the first communication port being disposed on a downstream side in the first direction and configured to deliver developer from the first chamber to the second chamber, the second communication port being disposed on an upstream side in the first direction and configured to deliver developer from the second chamber to the first chamber; and a partition member disposed in the first chamber above a discharge space communicated to the discharge port positioned downstream of the return conveyance portion in the first direction, and configured to divide a space within the first chamber in a gravity direction, wherein the first conveyance screw is arranged such that an upstream end in the first direction of the return conveyance portion is overlapped with the first communication port, the partition member is configured to extend from a wall portion on a downstream side of the developer container to a position corresponding to a downstream end of the return conveyance portion or to a position further upstream beyond the position corresponding to the downstream end of the return conveyance portion in the first direction, and a surface, opposed to the first conveyance screw, of the partition member is positioned downward in the gravity direction than an upper end of the first communication port and upward in the gravity direction than the first conveyance screw.

2. The developing apparatus according to claim 1, wherein a distal end of the partition member is positioned to overlap with the return conveyance portion in the first direction.

3. The developing apparatus according to claim 1, wherein the partition member is arranged with a gap of 1 mm or greater and 3 mm or smaller from an uppermost end portion of the first conveyance screw in the return conveyance portion.

4. The developing apparatus according to claim 1, wherein the partition member is formed in an inclined shape such that a distance between an upper wall portion of the developer container is narrowed from upstream toward downstream in the first direction.

5. The developing apparatus according to claim 4, wherein the partition member is formed to be inclined at an angle greater than an angle of repose of developer with respect to a horizontal plane.

6. The developing apparatus according to claim 1, wherein the partition member comprises a partition wall-side block portion configured to block a space intervened between the first conveyance screw and the partition wall.

7. The developing apparatus according to claim 6, wherein the partition member comprises an opposing wall portion-side block portion configured to block a space intervened between the first conveyance screw and an opposing wall portion of the developer container on an opposite side of the partition wall.

* * * * *